US008109761B1

(12) United States Patent
Neal et al.

(10) Patent No.: US 8,109,761 B1
(45) Date of Patent: Feb. 7, 2012

(54) DENTAL FURNACE WITH COOLING SYSTEM

(75) Inventors: Mike Neal, Louisville, KY (US); David Hall, Louisville, KY (US); Jay Doucette, Louisville, KY (US); Chenxi Yang, Prospect, KY (US)

(73) Assignee: Whip Mix Corporation, Louisville, KY (US)

( * ) Notice: Subject to any disclaimer, the term of this patent is extended or adjusted under 35 U.S.C. 154(b) by 744 days.

(21) Appl. No.: 11/672,244

(22) Filed: Feb. 7, 2007

Related U.S. Application Data

(60) Provisional application No. 60/766,813, filed on Feb. 13, 2006.

(51) Int. Cl.
*F27B 5/05* (2006.01)

(52) U.S. Cl. ..... 432/205; 432/189; 414/153; 414/172; 219/390

(58) Field of Classification Search ..... 432/206, 432/51, 258, 135, 239, 121, 253, 53, 203, 432/205, 176, 189, 199; 219/390, 385, 521, 219/391, 420, 424, 476–480, 388, 5, 393; 433/215, 26; 414/147, 153, 154, 172; 373/112, 373/115, 109
See application file for complete search history.

(56) References Cited

U.S. PATENT DOCUMENTS

| | | | | | |
|---|---|---|---|---|---|
| 3,845,807 | A * | 11/1974 | Koon | 164/255 |
| 4,272,670 | A * | 6/1981 | Docx | 219/390 |
| 4,332,553 | A * | 6/1982 | Earle et al. | 432/205 |
| 4,789,333 | A * | 12/1988 | Hemsath | 432/176 |
| 4,867,675 | A * | 9/1989 | Blackman | 432/5 |
| 5,554,226 | A * | 9/1996 | Okase et al. | 118/724 |
| 5,727,939 | A * | 3/1998 | Snyder | 432/205 |
| 6,252,202 | B1 * | 6/2001 | Zychek | 219/390 |
| 6,383,927 | B2 * | 5/2002 | Usami | 438/680 |
| 6,455,815 | B1 * | 9/2002 | Melgaard et al. | 219/390 |
| 6,852,601 | B2 * | 2/2005 | Yoshida et al. | 438/308 |
| 2004/0247013 | A1 * | 12/2004 | Clark et al. | 374/1 |
| 2007/0161315 | A1 * | 7/2007 | Kisoda et al. | 445/25 |
| 2008/0308551 | A1 * | 12/2008 | Wilcox et al. | 219/634 |

* cited by examiner

*Primary Examiner* — Gregory A Wilson

(74) *Attorney, Agent, or Firm* — Camoriano and Associates; Theresa Fritz Camoriano

(57) ABSTRACT

A cooling system for a dental porcelain furnace speeds up the cycle time for the furnace.

8 Claims, 6 Drawing Sheets

DENTAL FURNACE WITH COOLING SYSTEM

This application claims priority from U.S. Provisional Application Ser. No. 60/766,813, filed on Feb. 13, 2006, which is hereby incorporated herein by reference.

BACKGROUND

The present invention relates to dental porcelain furnaces. In a typical dental porcelain firing cycle, the porcelain work piece is placed on a firing table and then is slowly moved into a furnace chamber that is preheated to a starting temperature. The starting temperature, or entry temperature, of the furnace chamber is typically around 500 degrees Celsius. Once the work piece is in the chamber, air is evacuated from the chamber via an external vacuum pump. Then the temperature is raised, typically to approximately 750 to 1050 degrees Celsius, and the work piece is held at that temperature for a specified amount of time. At the end of the firing cycle, the work piece is moved out of the furnace chamber and is removed from the firing table. Before another work piece is run through the firing cycle, the operator waits until the furnace chamber cools down to the starting temperature.

SUMMARY

In the present example, air or some other gas is directed into the furnace chamber to accelerate cooling of the furnace chamber. This decreases the amount of time between firing cycles. In one embodiment, the vacuum pump assists in providing the cooling gas.

DETAILED DESCRIPTION

Figure 1:
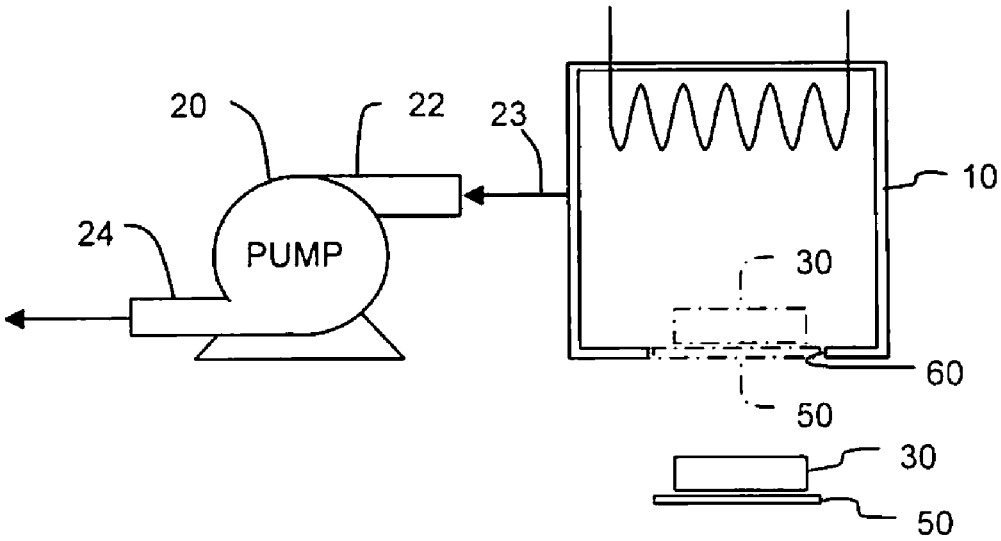
FIG. 1 PRIOR ART
FIG. 1 is a schematic view of a typical dental furnace found in the prior art.

FIG. 1 is a schematic view of a typical prior art dental porcelain furnace, including a furnace chamber 10 and a vacuum pump 20. The bottom of the furnace chamber 10 defines an opening 60 through which a dental work piece 30 may be inserted and removed. A firing table 50 supports the dental work piece 30, and it is movable between a lowered position and a raised position. In the lowered position, the work piece 30 may be loaded or removed from the firing table. In the raised position (shown in phantom in FIG. 1), the work piece 30 is raised into the furnace chamber 10 and the firing table 50 seals off the opening 60 in the bottom of the furnace chamber 10 so it can hold a vacuum. The vacuum pump 20 is used to draw a vacuum in the furnace chamber as the furnace temperature is raised to heat the dental work piece 30. The vacuum pump 20 has an inlet port 22, which communicates with the furnace chamber 10 through an inlet hose 23, and an exhaust port 24, which dispels air to the atmosphere.

In use, a dental work piece 30 is placed on the firing table 50, the furnace chamber 10 is brought to a starting or entry temperature, and the firing table 50 is raised vertically to lift the dental work piece 30 into the furnace chamber 10 and seal off the opening 60. Then, the vacuum pump 20 is activated, and it pumps air out of the furnace (discharging it to the atmosphere). As the air is being pumped out of the furnace chamber 10, the temperature in the furnace is increased until it reaches a final temperature, and the work piece 30 is held in the furnace at the desired temperature for the desired time. After the firing cycle is complete, the firing table 50 is lowered, and the furnace chamber 10 is allowed to cool. Once the furnace chamber has cooled down to the desired entry temperature, another work piece can be inserted, and another firing cycle can begin. The time required for cooling down the furnace chamber may be substantial, which limits the productivity of the furnace.

Figure 2:
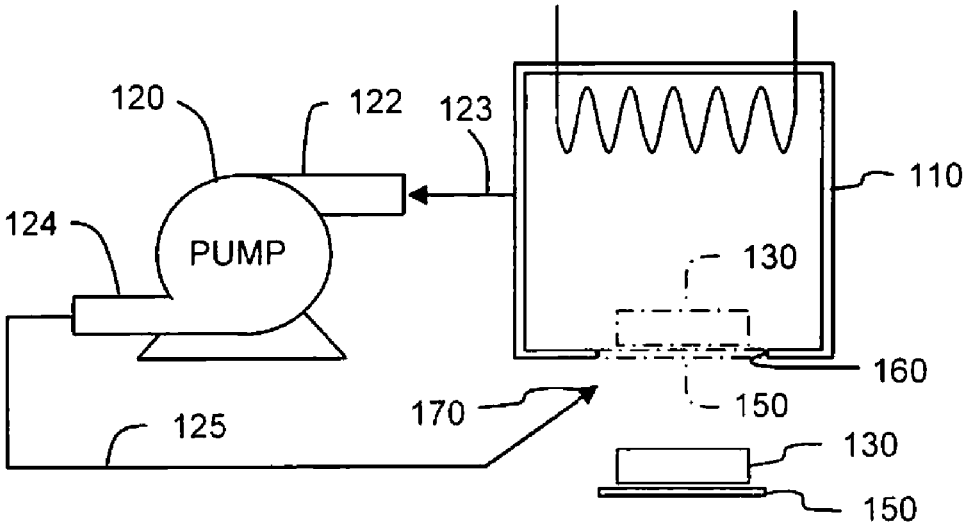
FIG. 2 is a schematic view of an example of a dental furnace having a cooling system made in accordance with the present invention.

FIG. 2 shows a schematic of a furnace including a furnace chamber 110 and vacuum pump 120 and having a cooling system made in accordance with the present invention. Like the vacuum pump of FIG. 1, this vacuum pump 120 has an inlet port 122 and inlet hose 123, with the inlet hose 123 providing gas communication between the vacuum pump 120 and the furnace chamber 110. The vacuum pump 120 also has an exhaust port 124. However, in this case, the exhaust port 124 is connected to an exhaust hose 125, which in turn, is connected to a nozzle or other gas outlet 170 that is directed toward the opening 160 in the furnace chamber 110.

With this configuration, the vacuum pump 120 not only serves its primary function of pumping air out of the furnace chamber 110 during the firing cycle, but it also helps cool down the furnace chamber 110 between firing cycles. When the firing table 150 is raised and the opening 160 is closed, the nozzle 170 simply discharges air to atmosphere. However, when the firing table 150 is lowered and the opening 160 is open, the nozzle 170, which is directed toward the opening 160, pulls additional outside air into the furnace 110 and creates an air circulation path through the furnace chamber 110 to cool the chamber 110. Thus, the pump 120 may be used after one firing cycle is completed to quickly cool the furnace chamber down to the specified entry temperature for the next firing cycle.

Figure 3:
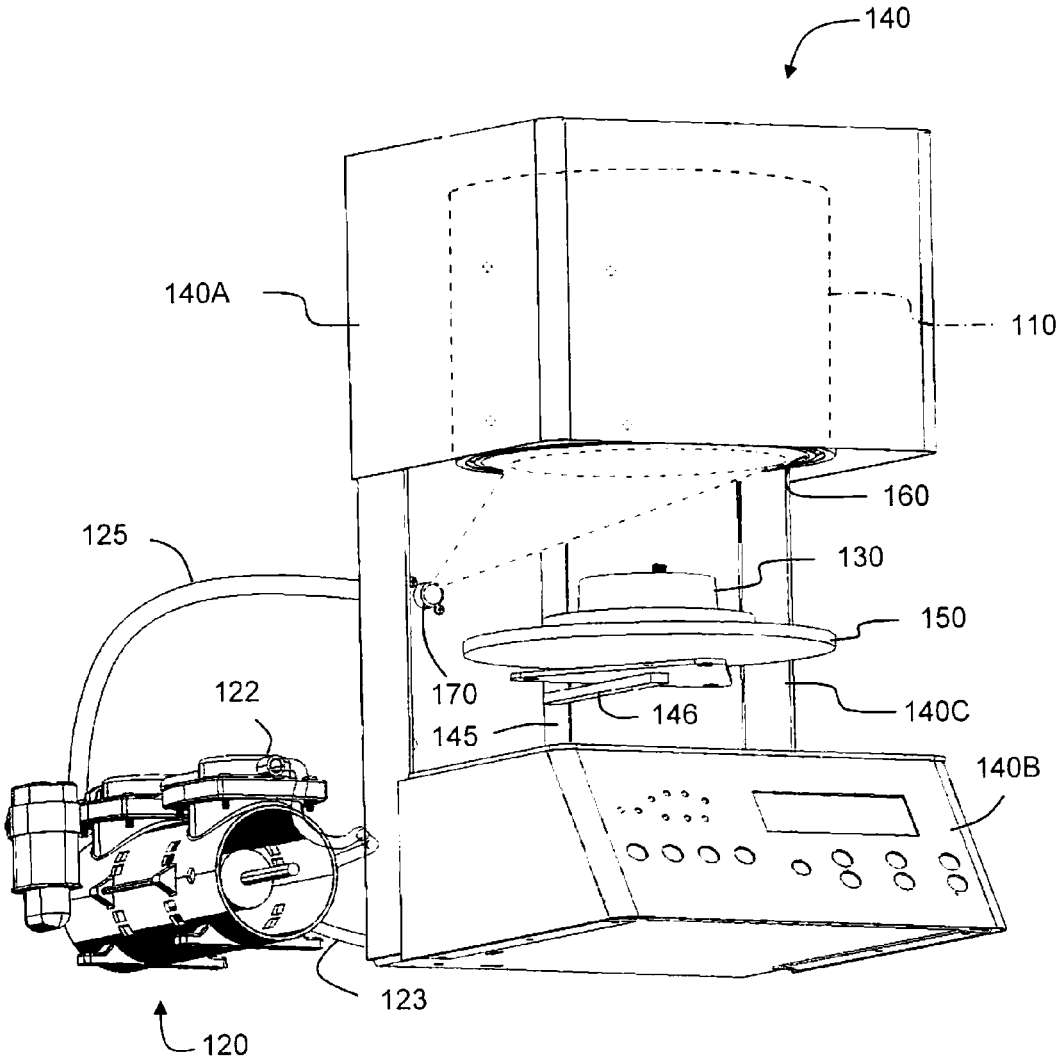
FIG. 3 is a front perspective view of the furnace of FIG. 2.
Figure 4:
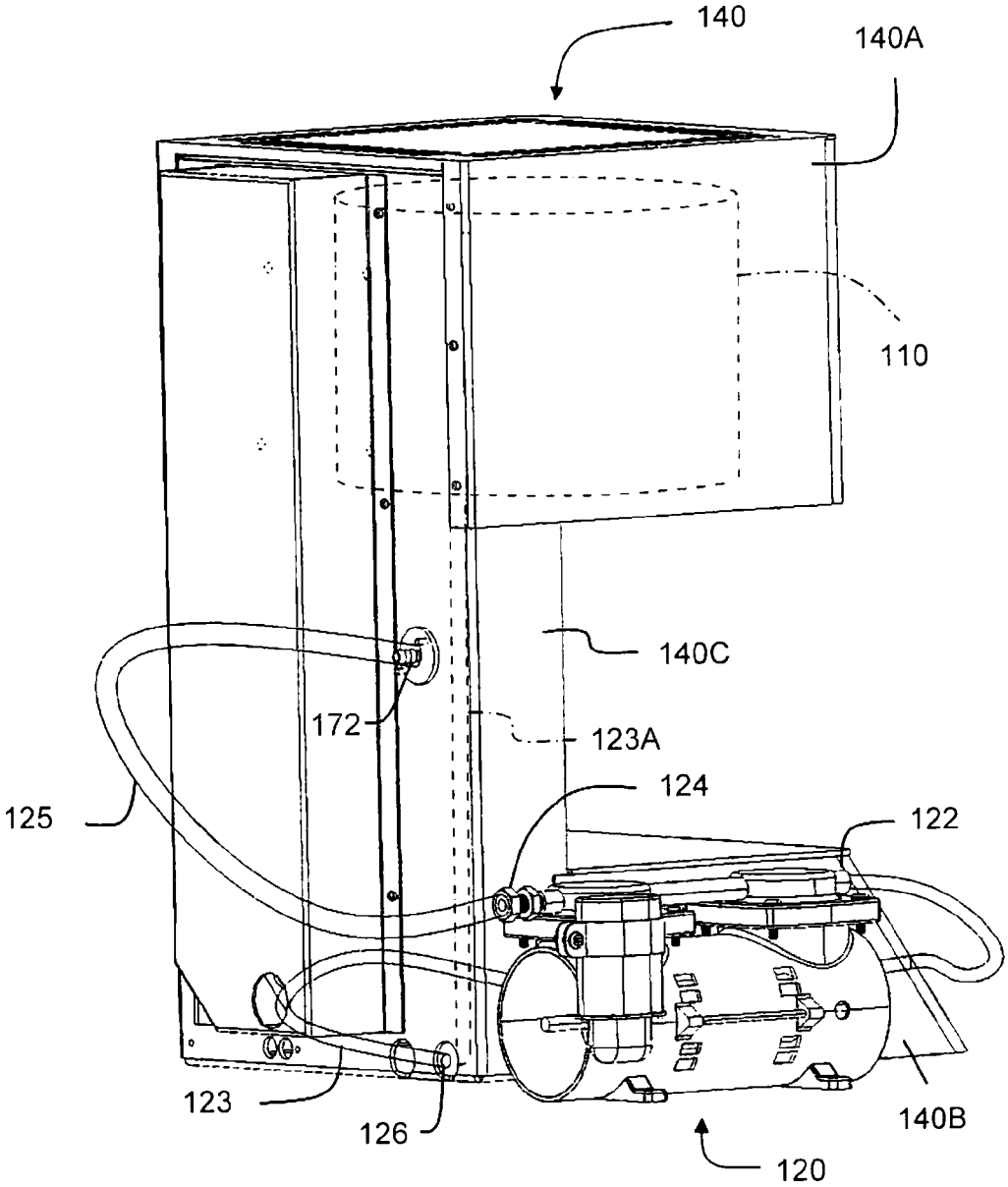
FIG. 4 is a rear perspective view of the dental furnace of FIG. 2.

FIGS. 3 and 4 are perspective views of a furnace 140 using the cooling system outlined in FIG. 2. The furnace 140 is programmable and includes an external vacuum pump 120. An upper section 140A of the furnace 140 houses the furnace chamber 110, and a lower section 140B includes circuitry, buttons and a display for programming the furnace 140. The circuitry of the lower section 140B and the heating arrangement for the furnace chamber 110 are not described here, as the basic structure and operation of dental furnaces is well known in the art. In addition, the furnace chamber 110 is shown in phantom lines to generally indicate its location in the upper section 140A of the furnace 140. It is not intended to illustrate the furnace chamber 110 in detail.

The upper section 140A and lower section 140B of the furnace 140 are separated by a middle section 140C, and the middle section 140C includes a vertical wall defining a track 145, which guides an arm 146 connected to the firing table 150, as is known in the art. The arm 146 and firing table 150 are raised and lowered by a motor (not shown), as is also commonly known in the art. When the firing table 150 is fully raised, it closes off the opening 160 to the furnace chamber 110. When the firing table 150 is lowered, the opening 160 is exposed.

Departing from the typical configuration of the prior art, this furnace 140 includes a nozzle or other gas outlet 170 mounted on its middle section 140C, and the nozzle 170 is directed toward the opening 160 of the furnace chamber 110. The nozzle 170 extends through the vertical wall in the middle section 140C of the furnace 140 and has a barbed fitting 172 projecting out the back of the wall (shown in FIG. 4). The barbed fitting 172 receives one end of an exhaust hose 125, and the other end of the exhaust hose 125 is connected to the exhaust port 124 of the vacuum pump 120. Thus, the nozzle 170 directs air discharged from the vacuum pump 120 toward the opening 160 of the furnace chamber 110. As depicted in FIG. 3, the nozzle 170 preferably is configured to spray air as an expanding stream, such that it pulls outside air into the opening 160 of the furnace chamber 110. When the firing table 150 is raised to seal the opening 160, air expelled from the vacuum pump 120 simply strikes the bottom of the firing table 150 and dissipates into the atmosphere.

The inlet port 122 of the vacuum pump 120 is connected to the inlet hose 123, which is connected to a vacuum port 126 on the back of the furnace 140, as is common in the art. In this embodiment, the inlet hose 123, as well as the exhaust hose 125, are made of clear plastic. Of course, other types of hoses or tubing could alternatively be used. The vacuum port 126 is connected to the furnace chamber 110 via an internal inlet hose portion 123A inside the furnace, as is also common in the art. The internal inlet hose portion 123A shown in FIG. 4 is simplified for illustrative purposes, and the actual routing of the internal hose 123A may be more complex. However, the inlet hose 123 and internal inlet hose portion 123A together provide gas communication between the furnace chamber 110 and the vacuum pump 120. When the pump 120 is activated, air in the furnace chamber 110 is pumped through the hoses 123, 123A into the vacuum pump 120, then out through the outlet hose 125 to the nozzle 170.

When the firing table 150 is in the lowered position, a dental work piece 130 may be placed on the firing table 150, and the furnace 140 is ready to be programmed for a particular firing cycle. For each programmed firing cycle, a desired starting or entry temperature is specified, typically around 500 degrees Celsius. The starting or entry temperature is the temperature at which the furnace chamber 110 should be when the work piece 130 enters the furnace chamber 110. A temperature measuring instrument (not shown), such as a thermometer or thermocouple, measures the temperature in the furnace chamber 110, and the measured temperature in the furnace chamber 110 should match the desired starting or entry temperature before each firing cycle begins. If the furnace 140 has not been used for a while, then the temperature in the furnace chamber 110 would be raised before inserting the work piece. However, if the temperature in the furnace chamber 110 is higher than the desired starting or entry temperature (e.g. a firing cycle has just completed), then the furnace chamber 110 is cooled down to the desired starting or entry temperature before inserting the work piece.

In this embodiment, the cooling provided by the vacuum pump 120 is controlled by activating the vacuum pump 120 in response to a comparison between the measured temperature in the furnace chamber 110 and the desired starting or entry temperature, if the actual temperature is higher than the desired starting or entry temperature. To elaborate, a user activates a particular program by using the buttons on the lower section 140B of the furnace 140. The program defines a particular firing cycle, which has a particular entry temperature, heat rate, hold time, and so forth. When the program is activated, the furnace 140 measures the temperature currently in the furnace chamber 110 and compares it to the programmed entry temperature. If the programmed entry temperature is lower than the measured temperature, the furnace 140 switches on the vacuum pump 120 (through internal circuitry) to cool the furnace chamber 110. The vacuum pump 120 withdraws hot air from the furnace chamber 110, and the exhaust from the vacuum pump 120 is directed back toward the furnace chamber 110 through the nozzle 170. The stream of air exiting the nozzle 170 pulls fresh air into the chamber, cooling the furnace chamber 110.

Once the furnace chamber 110 has cooled to the programmed entry temperature, the furnace control system turns off the vacuum pump 120, the work piece is placed on the work table 150, the table is raised to close the furnace chamber 110, and the firing cycle is initiated. The vacuum pump 120 then is switched back on as part of the firing cycle, as was described earlier. Of course, if the temperature measured in the furnace chamber at the time a program is activated is lower than the programmed entry temperature, then the vacuum pump is not turned on to cool the furnace chamber (as no cooling is necessary). Instead, the furnace chamber is heated to the desired entry temperature.

In this embodiment, the pump is switched on and off in response to the measured temperature in comparison to the desired entry temperature. However, other ways of activating the cooling system could alternatively be used. For example, the furnace may be programmed to switch the pump on automatically at the end of a firing cycle, the pump may be controlled by a switch that is activated in response to the vertical movement of the firing table, or the pump may be on from the time a button is pushed to initiate a cycle until the furnace is turned off. Alternatively, the pump could be switched on and off manually at the appropriate time, if desired.

Figure 5:
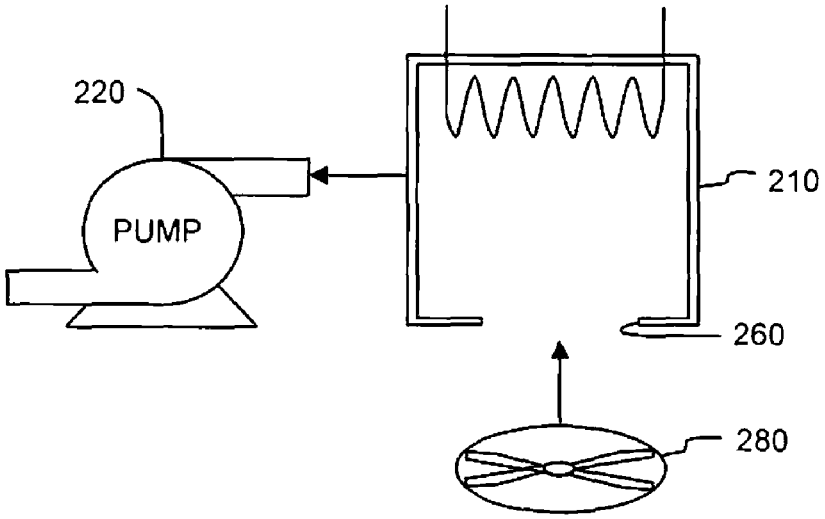
FIG. 5 is a schematic view of another example of a dental furnace having a cooling system made in accordance with the present invention.

FIG. 5 is a schematic of another example of a cooling arrangement for a furnace chamber 210. In this embodiment, the cooling air injected into the furnace chamber 210 comes from a fan 280 instead of the vacuum pump, so the fan 280 blows air into the chamber 210, while the pump pulls air out of the chamber 210. The fan 280 may be a separate unit or it may be built directly into the furnace. The fan 280 directs air toward the furnace opening 260 for cooling. The fan 280 may be electronically linked to the furnace controls so that it can be programmed to switch on and off (similar to the previous embodiment). Alternatively, the fan 280 may be linked to a mechanical switch to activate the fan when the firing table is lowered and deactivate the fan when the firing table is raised. Various other controls alternatively could be used. For example, the fan could be turned on and off whenever the vacuum pump turns on and off, or it could simply remain on whenever the furnace is in operation.

Figure 6:
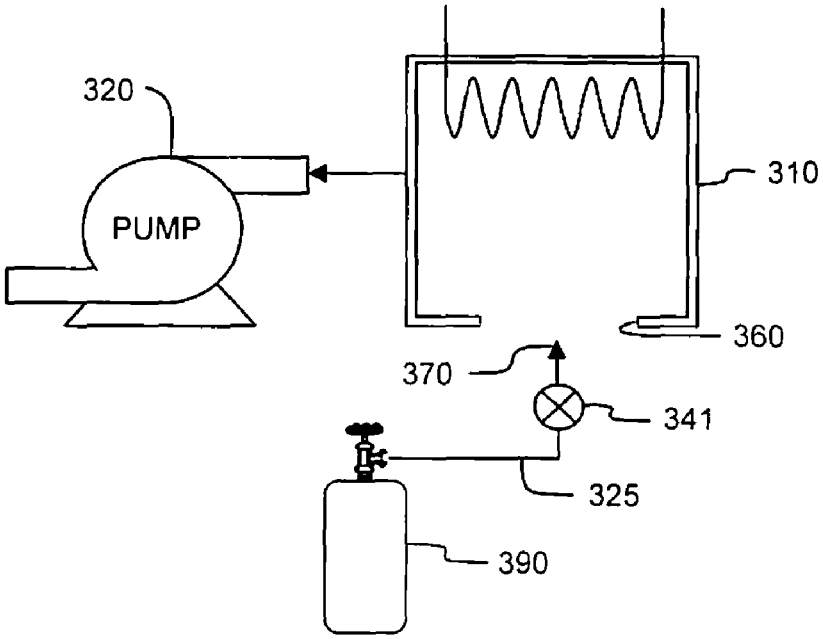
FIG. 6 is a schematic view of yet another example of a dental furnace having a cooling system made in accordance with the present invention.

FIG. 6 shows a schematic of yet another example of a cooling arrangement for a furnace chamber 310. In this embodiment, the gas for cooling the furnace chamber 310 comes from a compressed gas supply 390. The gas could be any gas that is stable at high temperature and is not chemically reactive with the furnace components. Examples of gases that may be used include air, carbon dioxide, nitrogen, and argon.

Figure 7:
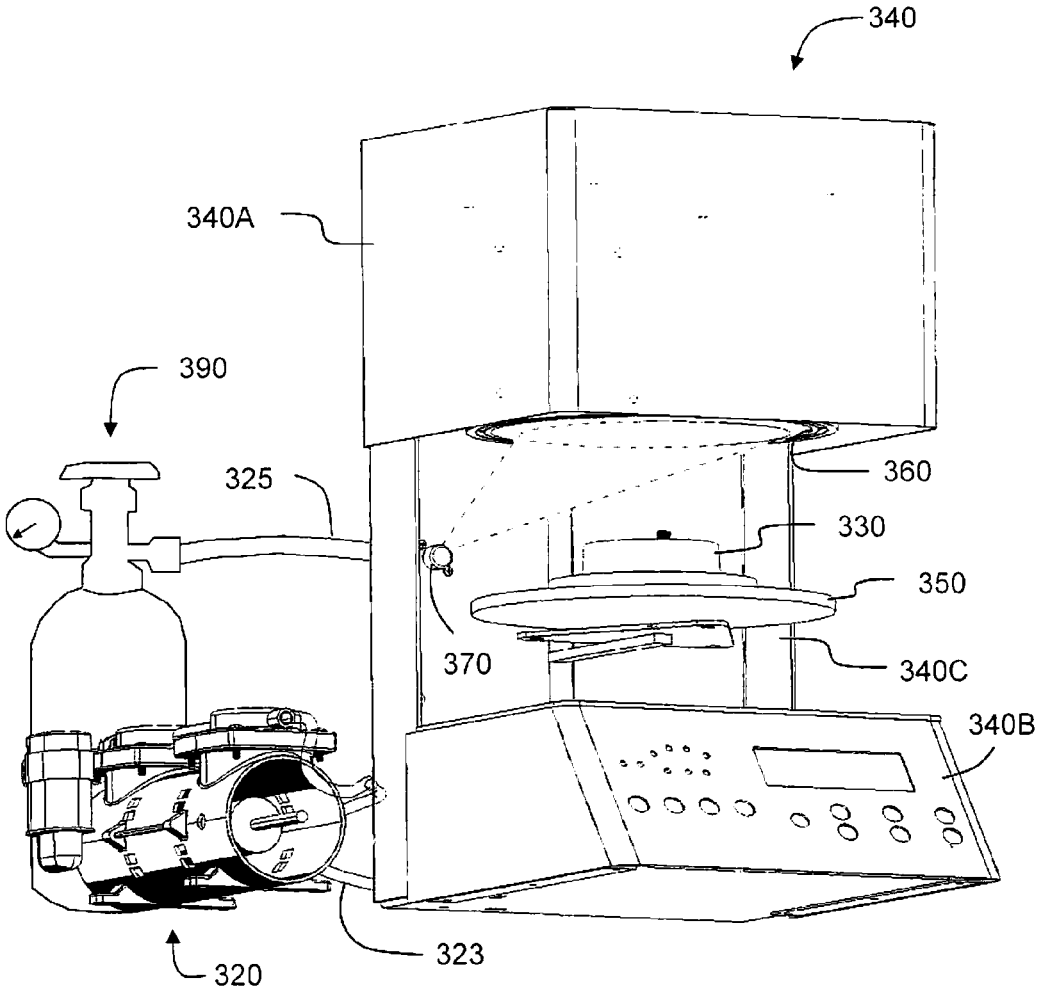
FIG. 7 is a front perspective view of the furnace of FIG. 6.
Figure 8:
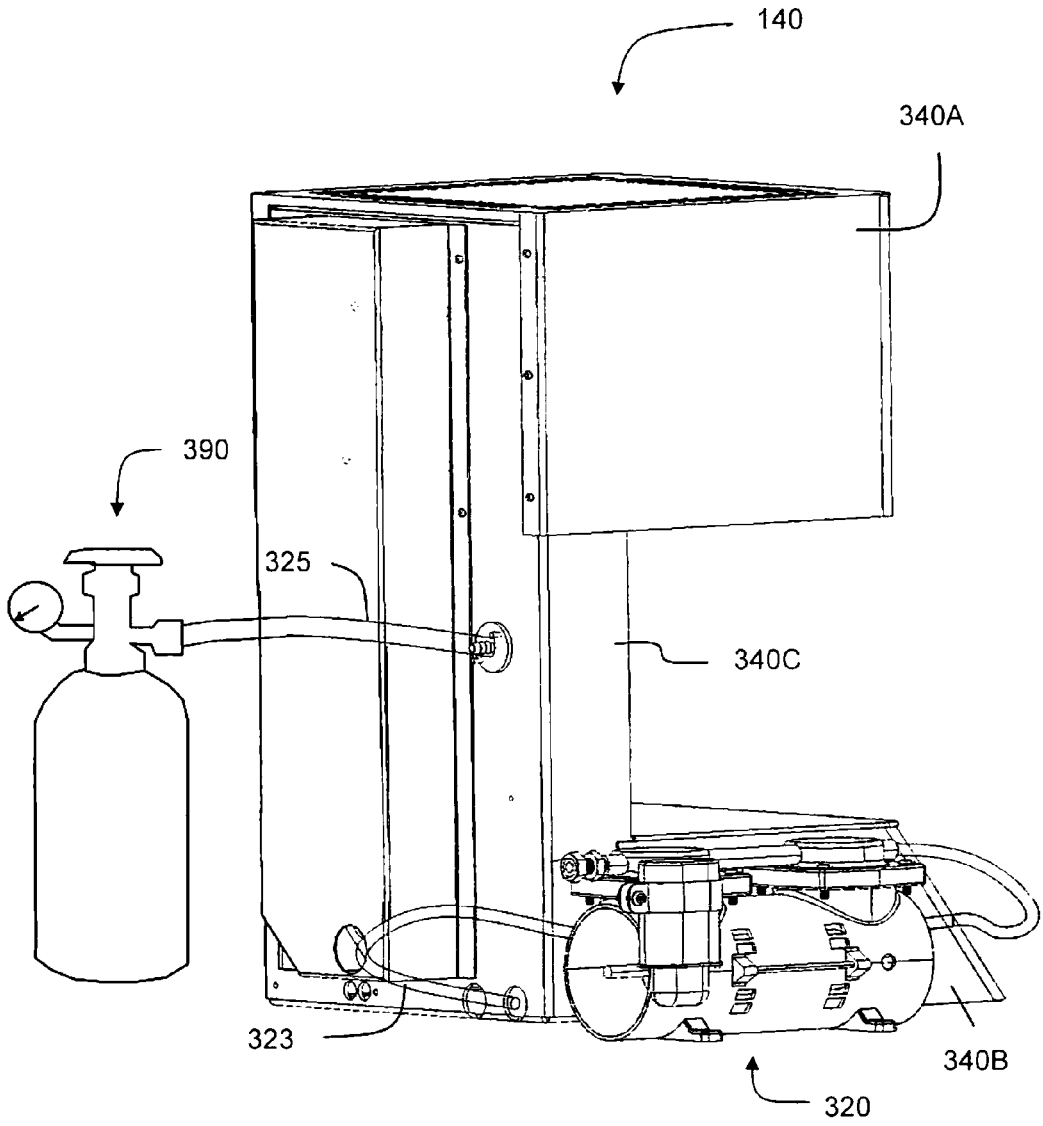
FIG. 8 is a rear perspective view of the dental furnace of FIG. 6.

FIGS. 7 and 8 show more details of the system of FIG. 6. The compressed gas supply 390 is in fluid communication with the nozzle 370 via a hose 325. The nozzle 370 is positioned on the middle section 340C of the furnace 340, and a control valve 341 (shown in FIG. 6) controls the discharge of gas. The control valve 341 in this embodiment is inside the middle section 340C of the furnace 340 and is not shown in FIGS. 7 and 8.

When the furnace chamber 310 is to be cooled, the valve 341 is opened and gas flows through the hose 325 and nozzle 370 toward the opening 360 in order to cool the furnace chamber 310 (shown in FIG. 6) in the upper section 340A of the furnace 340. In this case, the control valve 341 is opened and closed via the programmable controls on the lower section 340B of the furnace 340 similar to switching the pump on and off as in the first embodiment. Alternatively, the valve could be mechanically controlled, such as in response to the movement of the firing table 350. At the same time that the compressed gas is injected into the furnace chamber 310, the vacuum pump 320 is removing gas from the chamber 310 through the hose 323. Although the compressed gas supply 390 shown here is a portable cylinder or canister, it also could be hooked up to a central gas supply system or the like, such as those available in many laboratory fume hoods or work stations. FIG. 7 shows the work piece 330 resting on the firing table 350.

It should be noted that existing dental furnaces, such as the furnace shown in FIG. 1, may be retrofitted by adding a hose from the discharge of the vacuum pump and directing the discharge toward the furnace chamber opening.

It will be obvious to those skilled in the art that modifications may be made to the embodiments described above without departing from the scope of the invention as claimed.

What is claimed is:

1. A method of operating a dental furnace having a furnace chamber, comprising the steps of:

opening an inlet opening into the furnace chamber;

inserting a first product to be heated into the open furnace chamber through the inlet opening;

closing the furnace chamber with the product inside;

heating the furnace chamber and the product;

then reopening the furnace chamber; and then injecting gas into the furnace chamber through the inlet opening while removing gas from the furnace chamber to create a flow of cooling gas to cool down the furnace chamber.

2. A method of operating a dental furnace having a furnace chamber as recited in claim 1, and further comprising the step of inserting a second product into the furnace chamber after injecting gas into the furnace chamber.

3. A method of operating a dental furnace having a furnace chamber as recited in claim 1, wherein said dental furnace includes a gas outlet external to and directed toward said inlet opening of said furnace chamber and a vacuum pump in fluid communication with said furnace chamber and said gas outlet, wherein said pump is used for removing gas from the furnace chamber and for injecting gas into said furnace chamber through said gas outlet.

4. A method of operating a dental furnace having a furnace chamber as recited in claim 3, and further comprising the step of:

setting a target temperature for the furnace chamber;

measuring the temperature in the furnace chamber; and automatically activating said vacuum pump to cool the furnace chamber if the measured temperature is higher than the target temperature.

5. A method of operating a dental furnace having a furnace chamber as recited in claim 4, and further comprising the step of activating said vacuum pump when the furnace chamber is closed.

6. A method of operating a dental furnace having a furnace chamber as recited in claim 1, wherein a vacuum pump is used for removing gas from the furnace chamber, and a fan is used for injecting gas into the furnace chamber.

7. A method of operating a dental furnace having a furnace chamber as recited in claim 1, wherein a vacuum pump is used for removing gas from the furnace chamber, and a source of compressed gas is used for injecting gas into the furnace chamber.

8. A dental furnace, comprising:

a furnace chamber defining an opening for inserting a product into said chamber;

a vacuum pump including an inlet port and a discharge port, said inlet port in fluid communication with said furnace chamber;

a gas outlet external to said furnace chamber and directed toward said opening;

means for supplying gas to said gas outlet;

means for measuring the temperature in the furnace chamber; and means for automatically activating said vacuum pump between heating cycles when the measured temperature is higher than a set temperature.

* * * * *